US007854320B2

(12) United States Patent
Greene et al.

(10) Patent No.: US 7,854,320 B2
(45) Date of Patent: Dec. 21, 2010

(54) PACKAGE FOR HOLDING AND DISPLAYING SHAVING RAZORS

(75) Inventors: Jeffrey Allen Greene, Milton, MA (US); Richard Kevin Sennett, Abington, MA (US)

(73) Assignee: The Gillette Company, Boston, MA (US)

( * ) Notice: Subject to any disclaimer, the term of this patent is extended or adjusted under 35 U.S.C. 154(b) by 0 days.

(21) Appl. No.: 12/367,713

(22) Filed: Feb. 9, 2009

(65) Prior Publication Data

US 2010/0200443 A1 Aug. 12, 2010

(51) Int. Cl.
*A45C 11/26* (2006.01)

(52) U.S. Cl. ..... 206/354; 206/355; 206/356; 206/359

(58) Field of Classification Search ..... 206/83, 206/208, 228, 350, 351, 352, 353, 354, 355, 206/359, 377, 383, 388, 477, 478, 479, 480, 206/481, 482, 483, 459.5; 30/34.05
See application file for complete search history.

(56) References Cited

U.S. PATENT DOCUMENTS

| | | | | | |
|---|---|---|---|---|---|
| 3,970,194 | A | | 7/1976 | Iten | |
| 4,153,162 | A | * | 5/1979 | Samsing | 206/476 |
| D255,327 | S | | 6/1980 | Samsing | |
| D256,995 | S | * | 9/1980 | Kiraly | D9/749 |
| D257,327 | S | * | 10/1980 | Samsing | D9/722 |
| D265,056 | S | | 6/1982 | Hadtke | |
| 5,282,534 | A | * | 2/1994 | Lapp | 206/232 |
| 5,407,066 | A | | 4/1995 | Grange | |
| 5,429,241 | A | | 7/1995 | Althaus | |
| 5,782,346 | A | | 7/1998 | Gray et al. | |
| 5,899,329 | A | * | 5/1999 | Hu et al. | 206/376 |
| 6,276,529 | B1 | * | 8/2001 | Feehan, Jr. | 206/469 |
| 6,401,923 | B1 | * | 6/2002 | Huang | 206/376 |
| 6,415,517 | B1 | * | 7/2002 | Worrick, III | 30/541 |
| 6,499,601 | B1 | | 12/2002 | Foster et al. | |
| 6,513,655 | B2 | | 2/2003 | Logan et al. | |
| 6,648,140 | B2 | | 11/2003 | Petricca | |
| 6,786,515 | B2 | * | 9/2004 | Franko, Sr. | 283/81 |
| 6,789,676 | B2 | | 9/2004 | Logan et al. | |
| 6,886,690 | B2 | | 5/2005 | Petricca | |
| D511,105 | S | * | 11/2005 | Dominesey et al. | D9/748 |
| 2009/0321292 | A1 | * | 12/2009 | Prudden, Jr. et al. | 206/354 |

FOREIGN PATENT DOCUMENTS

| | | |
|---|---|---|
| EP | 0 605 880 A2 | 12/1993 |

* cited by examiner

*Primary Examiner*—Mickey Yu
*Assistant Examiner*—Rafael Ortiz
(74) *Attorney, Agent, or Firm*—John M. Lipchitz; Kevin C. Johnson; Steven W. Miller

(57) ABSTRACT

A disposable package is provided having a tub with a generally level bottom surface and a first shaving razor and a second shaving razor disposed within the tub. The first and second shaving razors each have a proximal end portion and a distal end portion. A first retaining member projects from the bottom surface and has first and second surfaces. The second surface of the first retaining member engages the distal end portion of the second shaving razor and the first surface of the first retaining member engages the proximal end portion of the first shaving razor.

10 Claims, 11 Drawing Sheets

PACKAGE FOR HOLDING AND DISPLAYING SHAVING RAZORS

FIELD OF THE INVENTION

The present invention relates to packages and trays for holding and displaying multiple personal care articles and more particularly to disposable packages for holding and displaying multiple shaving razors.

BACKGROUND OF THE INVENTION

Personal care articles such as shaving razors and tooth brushes are typically sold in clear plastic product packages containing a plurality of product units. These plastic packages are commonly referred to as blister packages and conventionally include a transparent plastic blister with a sheet or card material inside the package or as an outer seal which may add rigidity to the package and facilitate suspension of the package from a hanger of a point-of-sale display. The sheet or card material will usually be printed with appropriate data concerning the product within the pack. The pack is typically configured so that on the point-of-sale display the blister is at the front so that the contents within the blister are clearly visible to the customer. The card is usually provided with tear perforations to provide access to the contents within the package.

Typically, individual product packages are received from a manufacturer in shipping containers with several individual product packages contained loosely therein. These product packages must then be removed from the shipping container by a retail employee and mounted to the hanger of a point-of-sale display. The product is typically jostled during shipment and mounting of the product to the point-of-sale display, which may affect the orientation of the product within the package. Some packages include a separate tray within the package which holds a single product, however, these trays add extra cost and are typically reused by the customer to hold or store the product after the pack is thrown away. Thus, these trays are not cost effective options for lower cost disposable items. Lower cost and disposable items that are packaged together are typically not secured and are allowed to move freely within the package. The movement of the items is limited only by the external shape of the package and the number of items in the package. Items that are not secured to the package may change orientation by the time they reach the point-of-sale display.

Personal care articles items such as shaving razors, combs, brushes, and tooth brushes are typically suspended from retail pegs or placed directly on store shelves. Therefore, as used herein, the term "package", or the phrase "product package" should be broadly construed to mean packaging for retaining personal care articles, such packaging being displayable.

SUMMARY OF THE INVENTION

In accordance with one aspect, the invention generally features a disposable package including a tub having a generally flat bottom surface and first and second shaving razors disposed within the tub. The first and second shaving razors each has a proximal end portion and a distal end portion. A first retaining member projects from the bottom surface and has first and second surfaces. The second surface of the first retaining member engages the distal end portion of the second shaving razor and the first surface of the first retaining member engages the proximal end portion of the first shaving razor.

In accordance with another aspect, the invention generally features a disposable package including a tub having a top surface, a generally level bottom surface, and a generally level back surface. A plurality of retaining members project from the bottom surface for retaining a plurality of personal care articles and a plurality of corresponding recesses extend into the back surface. A lid is removably sealed to the top surface and a label is mounted to the back surface for visually concealing the plurality of recesses.

BRIEF DESCRIPTION OF THE DRAWINGS

While the specification concludes with claims particularly pointing out and distinctly claiming the subject matter that is regarded as the present invention, it is believed that the invention will be more fully understood from the following description taken in conjunction with the accompanying drawings.

DETAILED DESCRIPTION OF THE INVENTION

Figure 1:
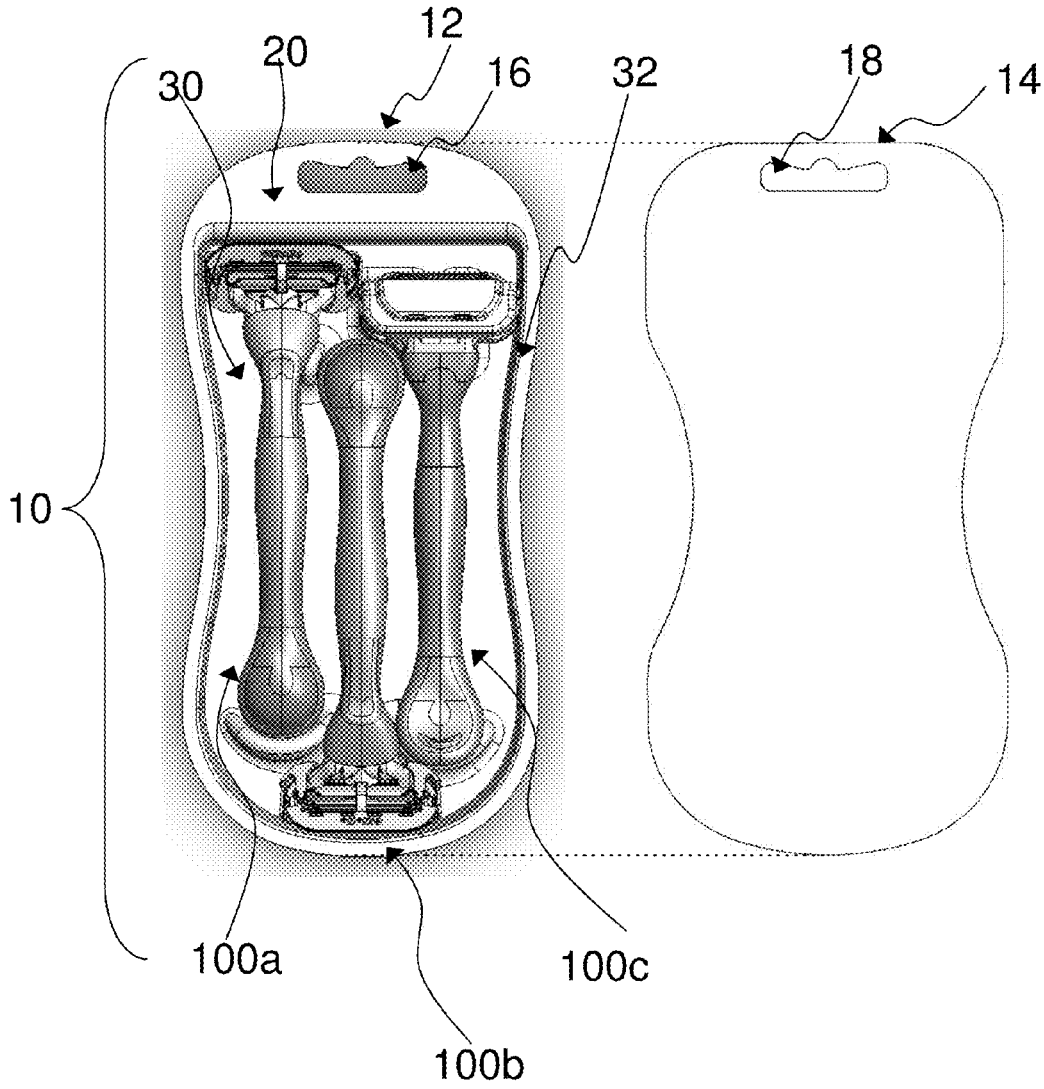
FIG. 1 is a top plan assembly view of one possible embodiment of a package for holding and displaying personal care articles.

Referring to FIG. 1, an assembly view of one possible embodiment of a package 10 for holding and displaying a plurality of personal care articles is shown. The package 10 may have a generally rectangular shape with one or more curved sides. The package 10 may include two primary components, a tub 12 made from a formable substrate and a lid 14. The tub 12 contains the product, such as a plurality of shaving razors 100*a*, 100*b* and 100*c*, and the lid 14 seals the products within the package. The shaving razors 100*a*, 100*b* and 100*c* may have different geometries and sizes or may be all the same, as shown in FIG. 1. The tub 12 may have a top surface 20 and a recessed bottom surface 30 that is defined by a perimeter wall 32. The top surface 20 may include a flange that provides an area for the lid 14 to seal against. In certain embodiments, the bottom surface 30 may be generally flat or level. In certain embodiments, two of the shaving razors 100*a* and 100*b* may face toward the bottom surface 30 of the tub 12 and one of the shaving razors 100*c* may face the lid 14, however, other orientations are also possible. Once the personal care articles are placed in the tub 12, the lid 14 may be joined to the top surface 20 of the tub 12. The top surface 20 of the tub 12 may define an aperture 16 that extends through the top surface 20 to facilitate suspension of the package 10 from a hanger of a point-of-sale display. The lid may also have a corresponding aperture 18.

In certain embodiments, the lid 14 may be a film or a plastic sheet that is heat sealed to the top surface 20. The tub 12 and/or lid 14 may be manufactured from generally translucent or transparent polymers, such that the consumer can view the personal care articles through the package 10. Opaque materials such as wood/paper pulp or Styrofoam may also be used if transparency is not required for the lid 14 or the tub 12. Examples of transparent or translucent polymers may include, but are not limited to polyolefins (e.g., polypropylene, high density polyethylene or low density polyethylene), polyesters (e.g., polyethylene terephthalate), and poly vinyl chloride (PVC). The tub 12 may be produced by thermoforming or other known processing methods such as injection molding, blow molding, cold forming, and injection blow molding. The lid 14 may be released or peeled away from the top surface 20 of the tub 12 to access the products disposed within the tub 12. In certain embodiments, the lid 14 and/or the top surface 20 may have an adhesive that allows the lid 14 to removed and resealed to the top surface 20 of the tub 12 repeatedly.

Figure 2A:
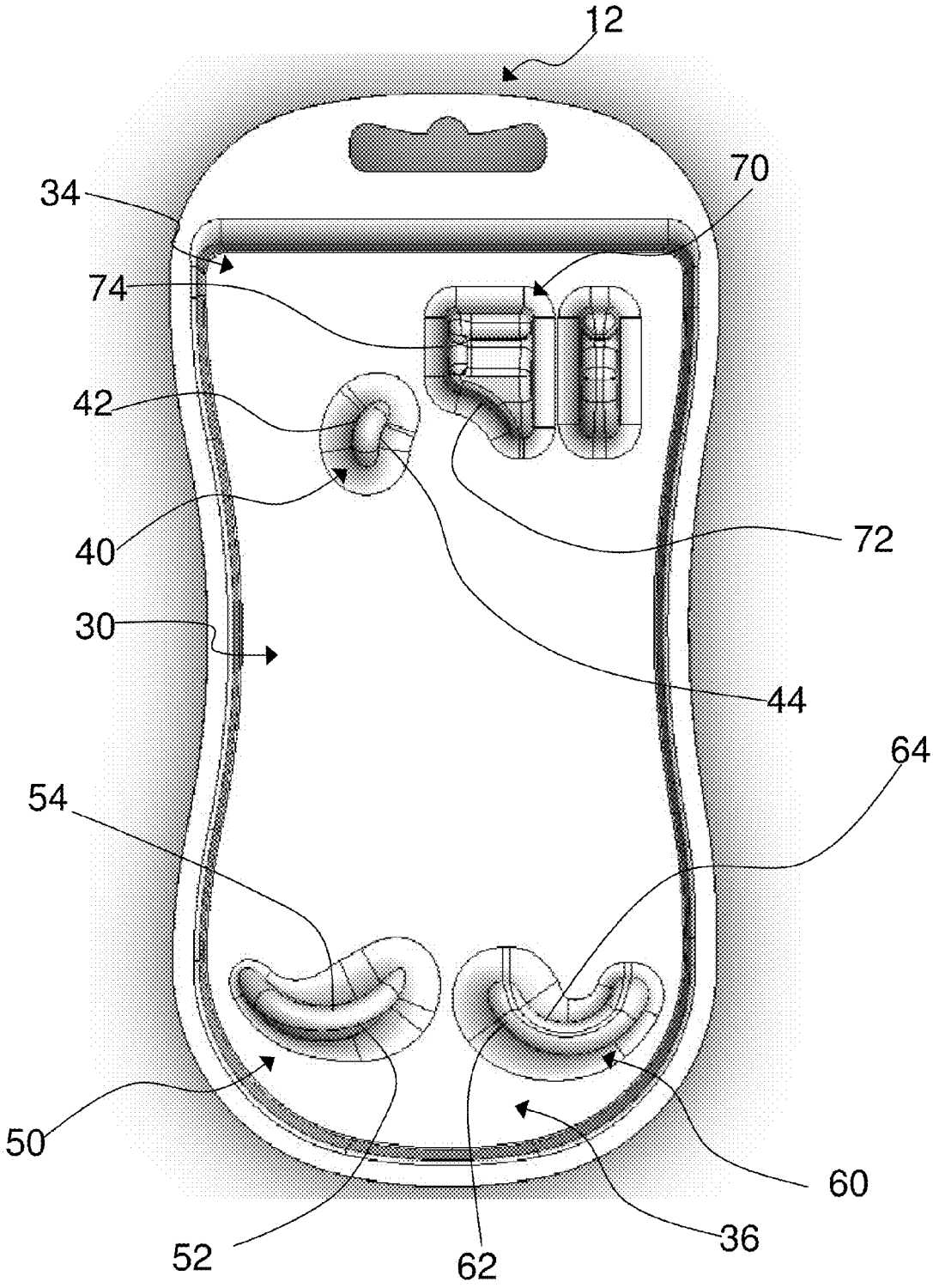
FIG. 2A is a top plan view of one possible embodiment of a tub which may be incorporated into the package of FIG. 1.

Referring to FIG. 2A, a top plan view of the tub 12 is illustrated. The bottom surface 30 may have a proximal end portion 34 and a distal end portion 36. A plurality of spaced apart retaining members 40, 50, 60 and 70 may project from the bottom surface 30. The spacing of the retaining members 40, 50, 60 and 70 may provide open and easy access to the shaving razors 100*a*, 100*b* and 100*c*, as shown if FIG. 1. In certain embodiments, the retaining members, 50, 60 and 70 may be formed as an integral part of the tub 12. In other embodiments, the retaining members 40, 50, 60, and 70 may be modular inserts which can be placed anywhere on the bottom surface 30, thus allowing greater design flexibility. For example, the same tub 12 may be used for holding a variety of shaving razors having different sizes and shapes by rearranging, adding or eliminating one or more of the retaining members 40, 50, 60, and 70. As will be described in greater detail below, the retaining members 40, 50, 60, and 70 may hold a plurality of personal care articles in a predetermined orientation and prevent the products from shifting during transport to the store or as the product is removed from the display by consumers. The retaining members 40, 50, 60, and 70 may also provide proper spacing between a plurality of products within the tub 12, thus giving the product a more aesthetically appealing appearance.

The plurality of retaining members 40, 50, 60, and 70 may have a generally arcuate profile and may be continuous or segmented. As will be described in greater detail below, each retaining member 40, 50, 60 and 70 may aid in retaining two or more personal care articles, such as a disposable shaving razor (not shown). Each of the retaining members may 40, 50, 60 and 70 may have a respective first and second surfaces 42 and 44, 52 and 54, 62 and 64, 72 and 74. The first and second surfaces 42 and 44, 52 and 54, 62 and 64, 72 and 74 may be generally arcuate which may aid in holding the shaving razors 100*a*, 100*b* and 100*c* within the tub 12. The second and third retaining members 50 and 60 may be located on opposite end portions of the tub 12 relative to the first and fourth retaining members 40 and 70. In certain embodiments, the first and fourth retaining members 40 and 70 may be may be located at the proximal end portion 34 and the second and third retaining members 50 and 60 may be located at the distal end portion 36.

Figure 2B:
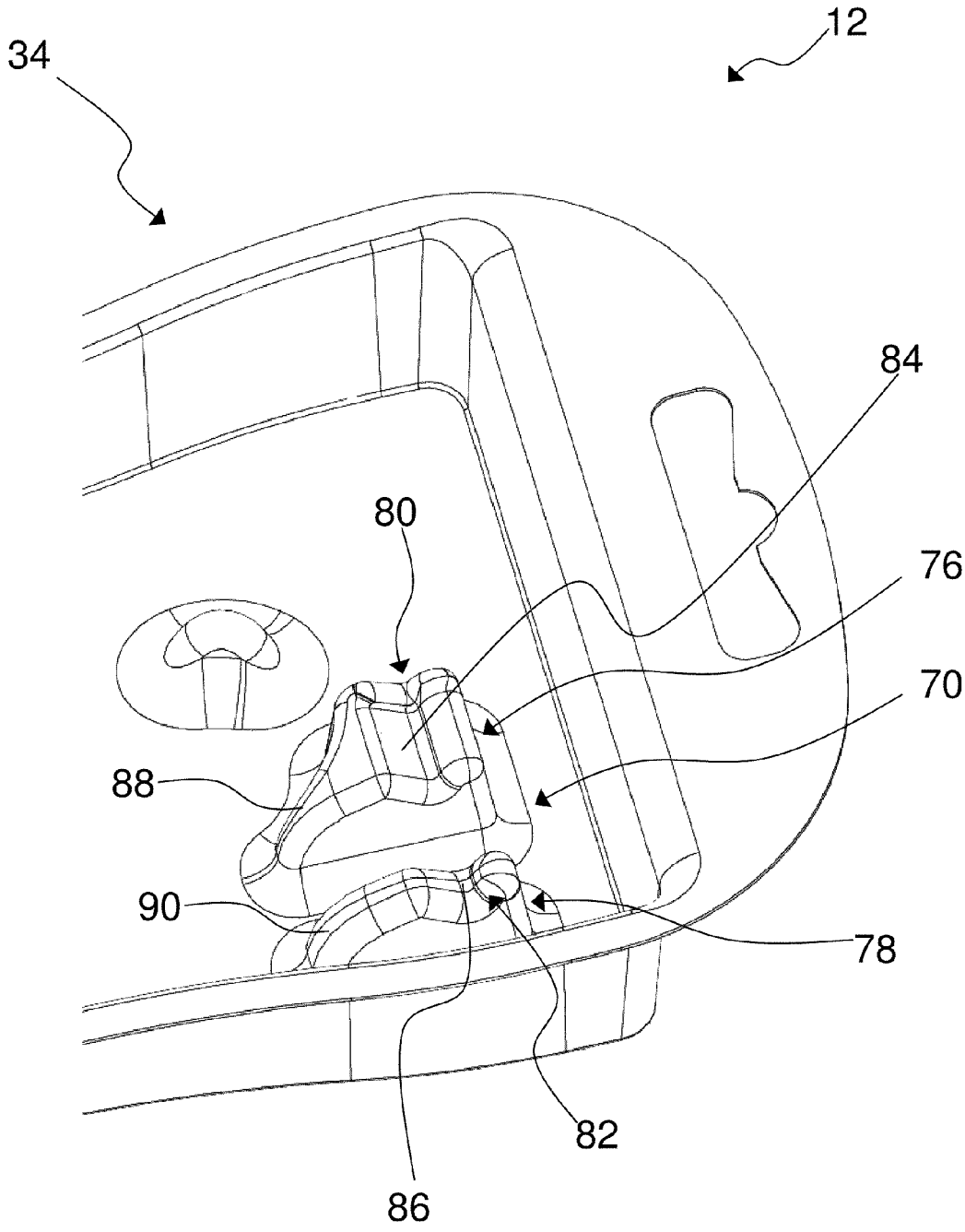
FIG. 2B is a detailed perspective view of the tub of FIG. 2A.

Referring to FIG. 2B, a perspective view of the proximal end portion 34 of the tub 12 is shown. Many personal care articles, such as shaving razors and toothbrushes have contoured surfaces. The contoured surfaces make it difficult to hold or display different surfaces of personal care articles without the personal care articles becoming disorganized within the package. For example, the contoured surface may be located between two end portions that are in the same plane, but the contoured surface may lie in a different plane. Such a configuration allows the personal care articles to lie evenly on a flat surface in only a single orientation. If the contoured surface of a product is placed on a flat surface of a package the product would have a propensity to tilt or tip over, resulting in a less than appealing display of the product to a potential consumer. The fourth retaining member 70 may be configured to limit a product having a contoured surface, such as shaving razors 100*a*, 100*b* and 100*c* (not shown), from tilting within a package. The fourth retaining member 70 may be continuous or may include a first segment 76 and a second segment 78. The first and second segments 76 and 78 may have a respective top surface 80 and 82 that define a respective notch 84 and 86. In certain embodiments, the notches 84 and 86 may be generally "V" or "U" shaped. The notch may allow the cartridge 110*c* that pivots relative to the handle 102*c* to be set at a predetermined angle. The angle of the notches 84 and 86 may be varied depending on the desired viewing angle of the cartridge 110*c* (not shown). The first and second segments 76 and 78 may have a respective front wall 88 and 90 that supports a contoured surface of the personal care article. The front walls 88 and 90 may be straight, inclined or arcuate.

Figure 3:
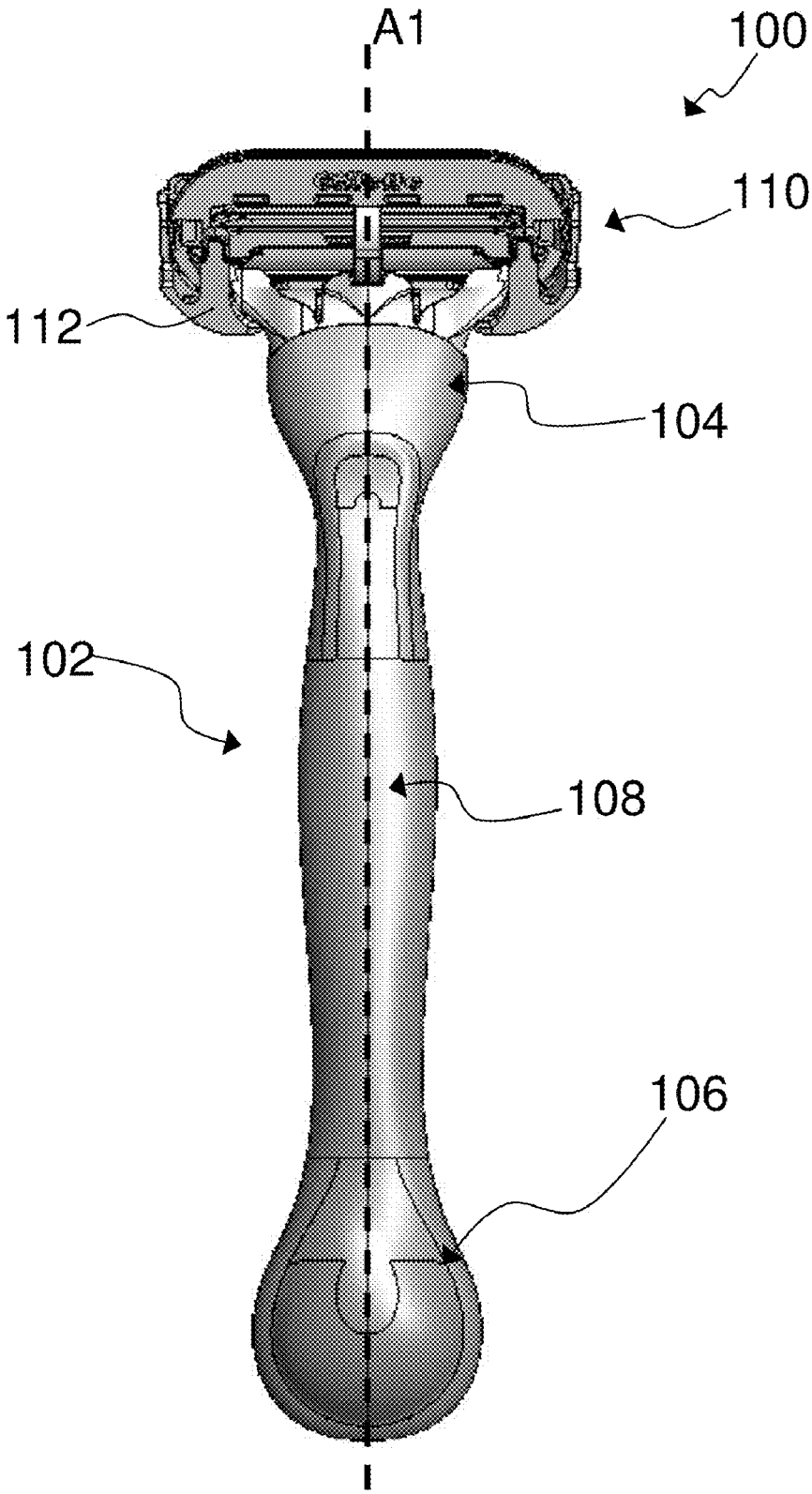
FIG. 3 is a top plan view of a shaving razor which may be disposed within the package of FIG. 1.

Referring to FIG. 3, a top view of one possible embodiment of the shaving razor 100 is shown which may be disposed within the tub 12. The shaving razor may have a handle 102 having a proximal end portion 104 and an enlarged distal end portion 106. The distal end portion 106 may have a generally round or circular shape. A cartridge 110 may be permanently or detachably mounted the proximal end portion 104 of the handle 102. In certain embodiments, the cartridge 110 may pivot relative to the handle 110, but the cartridge 110 may alternatively be fixed relative to the handle. An optional protective cover 112 may be mounted to the cartridge 110. At least a part of the proximal end portion 104 (and/or the cartridge 110) and the distal end portion 106 may lie in the same plane, such that shaving razor 110 may be placed on a flat surface without tilting or leaning. The handle 102 may have an arcuate top surface 108 that extend along a longitudinal axis A1 between the proximal end portion 104 and the distal end portion 106. The top surface 108 may be curved both along the longitudinal axis A1 and perpendicular to the longitudinal axis A1. The top surface 108 may have a convex profile such that the proximal end portion 104 (and/or the cartridge 110) and/or the distal end portion 106 are not in the same plane as the top surface 108. The arcuate profile of the top surface 108 may cause the shaving razor 100 to tilt when it is placed on a flat surface.

Figure 4A:
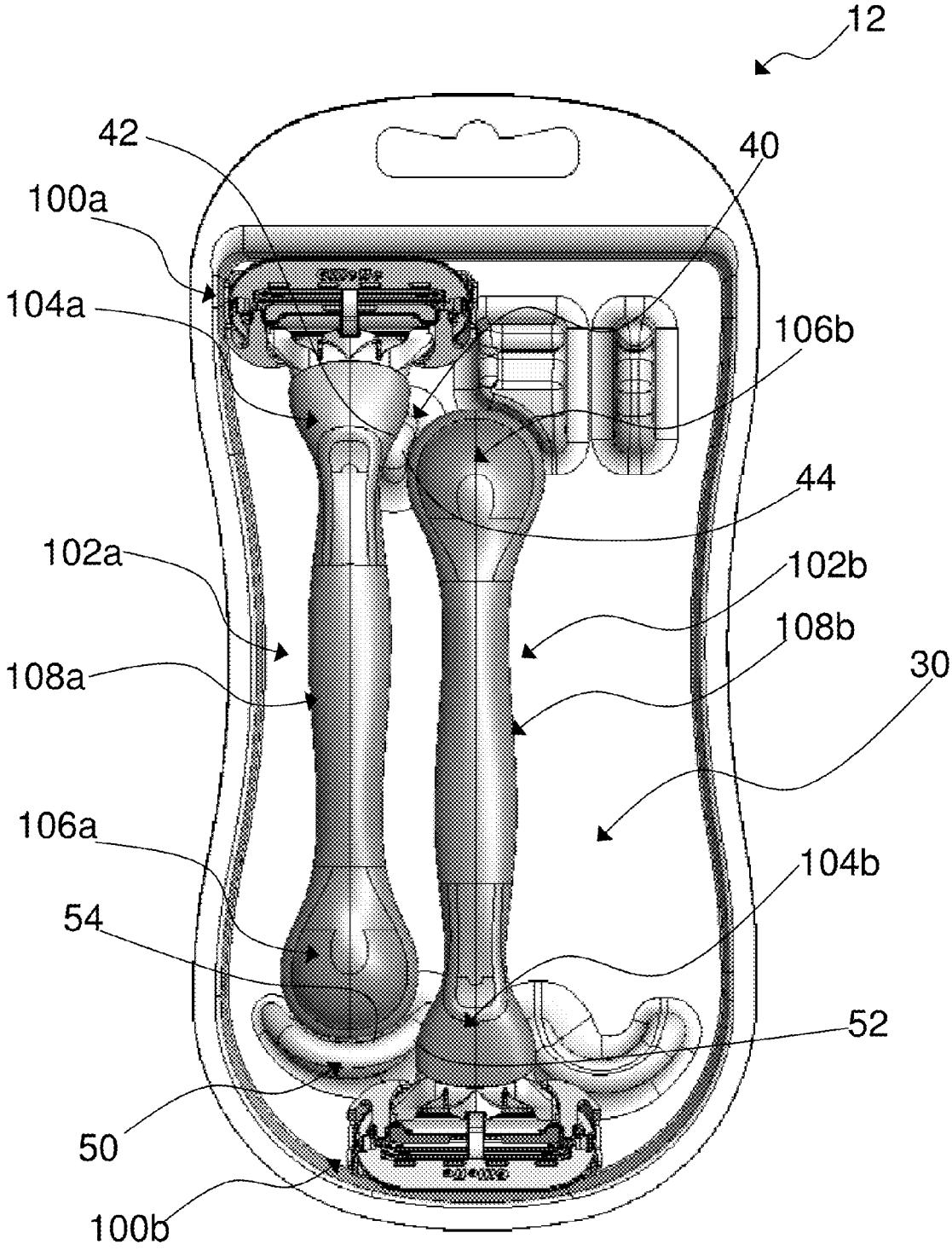
FIG. 4A is a top plan view of the tub of FIG. 2A and two of the shaving razors of FIG. 3.

FIG. 4A illustrates first and second shaving razors 100*a* and 100*b* disposed within the tub 12. The first and second retaining members 40 and 50 may be configured to engage two or more shaving razors 100*a* and 100*b*. The first retaining member 40 may be configured to engage the shaving razors 100*a* and 100*b*. The first surface 42 of the first retaining member 40 may engage the proximal end portion 104*a* of the handle 102*a* and the second surface 44 of the first retaining member 40 may engage the distal end portion 106*b* of handle 100*b*. The second retaining member 50 may also engage the shaving razors 100*a* and 100*b*. The first surface 52 of the second retaining member 50 may engage the proximal end portion 104*b* of the handle 102*b* and the second surface 54 of the second retaining member 50 may engage the distal end portion 106*a* of the handle 102*a*. At least a part of the distal end portions 104*a* and 104*b* and the cartridges 100*a* and 100*b* may lie generally flat on the bottom surface 30 of the tub 12. The top surfaces 108*a* and 108*b* of the respective handles 102*a* and 102*b* may not contact the bottom surface 30 of the tub 12.

Figure 4B:
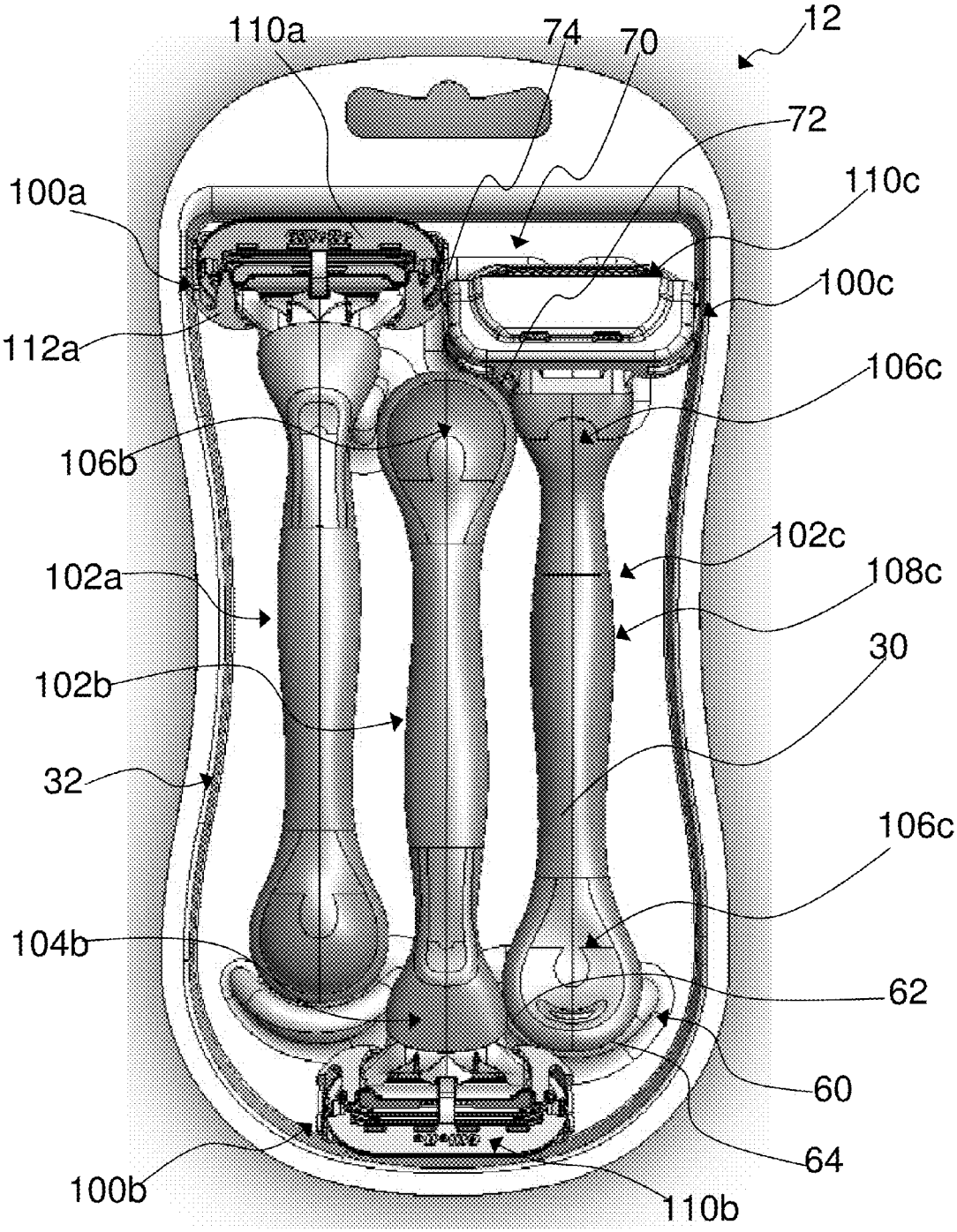
FIG. 4B is a top plan view of the tub of FIG. 2A and three of the shaving razors of FIG. 3.

FIG. 4B illustrates the first, the second and a third shaving razor 100*a*, 100*b* and 100*c* disposed within the tub 12. The third retaining member 60 may be configured to engage the second and third shaving razors 100*b* and 100*c*. The first surface 62 of the third retaining member 60 may engage the proximal end portion 104*b* of the handle 102*b* and the second surface 64 of the third retaining member 60 may engage the distal end portion 106*c* of the handle 100*c*. The fourth retaining member 70 may also engage multiple shaving razors 100*a*, 100*b* and 100*c*. The first surface 72 of the fourth retaining member 70 may engage the distal end portion 106*b* of the handle 102*b* and the second surface 74 of the fourth retaining member 70 may engage the cartridge 110*a* and/or protective cover 112*a* of the handle 102*a*. The contoured top surface 108*c* of the handle 102*c* may be in contact with the bottom surface 30 of the tub 12 and the notches 84 and 86 (not shown) of the fourth retaining member 70 may receive the cartridge 110*c* and/or protective cover 112*c*. The notches 84 and 86 may facilitate angling the cartridge 110*c* in a predetermined orientation, especially if the cartridge 110*c* pivots relative to the handle 102*c*. The consumer may have an improved view of the design elements of the cartridge 110*c* if the cartridge 110*c* is held at a certain angle relative to the handle 102*c*. Shaving razors having pivoting mechanisms can be damaged during shipping. The fourth retaining member 70 may aid in preventing the cartridge 110*c* from being damaged during shipping, which may be caused by excessive movement of the shaving razors within the package. The fourth retaining member 70 may prevent the third razor 100*c* from tilting by supporting the cartridge 110*c* and the proximal end portion 104*c*. The third retaining member 60 may support the distal end portion 106*c* to further stabilize the third shaving razor 100*c*.

The first shaving razor 100*a* may be secured within the tub 12 by contacting or engaging a plurality of different surfaces that limit longitudinal and/or lateral movement of the first shaving razor 100*a*. For example, the cartridge 110*a* (or cartridge cover 112*a*) of the first shaving razor 100*a* may be secured between the perimeter wall 32 of the tub 12 and the fourth retaining member 70 to limit lateral movement of the shaving razor 100*a*. Lateral movement of the first shaving razor 100*a* may also be limited by the proximal end portion 104*a* of the first shaving razor 100*a* contacting the first retaining member 40. The first shaving razor 100*a* may be positioned between the perimeter wall 32 and the second retaining member 50 to limit longitudinal movement. For example, the second retaining member 50 may contact or hold the distal end portion 106*a* of the first shaving razor 100*a* and the perimeter wall 32 may contact the cartridge 110*a* (or cartridge cover 112*a*) to limit the shaving razor 100*a* from shifting longitudinally. The second retaining member 50 may have a curved profile to further limit lateral movement of the distal end portion of the handle 102*a*.

The second shaving razor 100*b* may also be secured within the tub 12 by contacting or engaging a plurality of different surfaces to limit longitudinal or lateral movement of the second shaving razor 100*b*. For example, the handle 102*b* may be positioned between the first retaining member 40 and the fourth retaining member 70 to limit lateral movement of the second shaving razor 100*b*. The second and third retaining members 50 and 60 may further limit movement of the handle 102*b* a lateral and longitudinal direction. The proximal end portion 104*b* of the handle 102*b* may be positioned between the second and third retaining members 50 and 60 to limit lateral movement. The second shaving razor 102*b* may also be positioned between the second and third retaining members 50 and 60 and the perimeter wall 32 limit the second shaving razor 100*b* from moving longitudinally. Longitudinal movement of the second shaving razor 102*b* may also be limited by the first and fourth retaining members 40 and 70 which contact the distal end portion 106*b* of the handle 102*b* and by the perimeter wall 32 which contacts the shaving cartridge 110*b*.

The third shaving razor 100*c* may be secured within the tub 12 by contacting or engaging a plurality of different surfaces to limit longitudinal and/or lateral movement of the third shaving razor 100*c*. For example, the third shaving razor 100*c* may be positioned between the third and fourth retaining members 60 and 70 to limit longitudinal movement of the third shaving razor 100*c*. The third retaining member 60 may have a curved profile to limit any lateral movement of the distal end portion 106*c* of the handle 102*c*. The perimeter wall 32 may contact the cartridge 110*c* to limit lateral movement of the third shaving razor 100*c*.

Figure 5A:
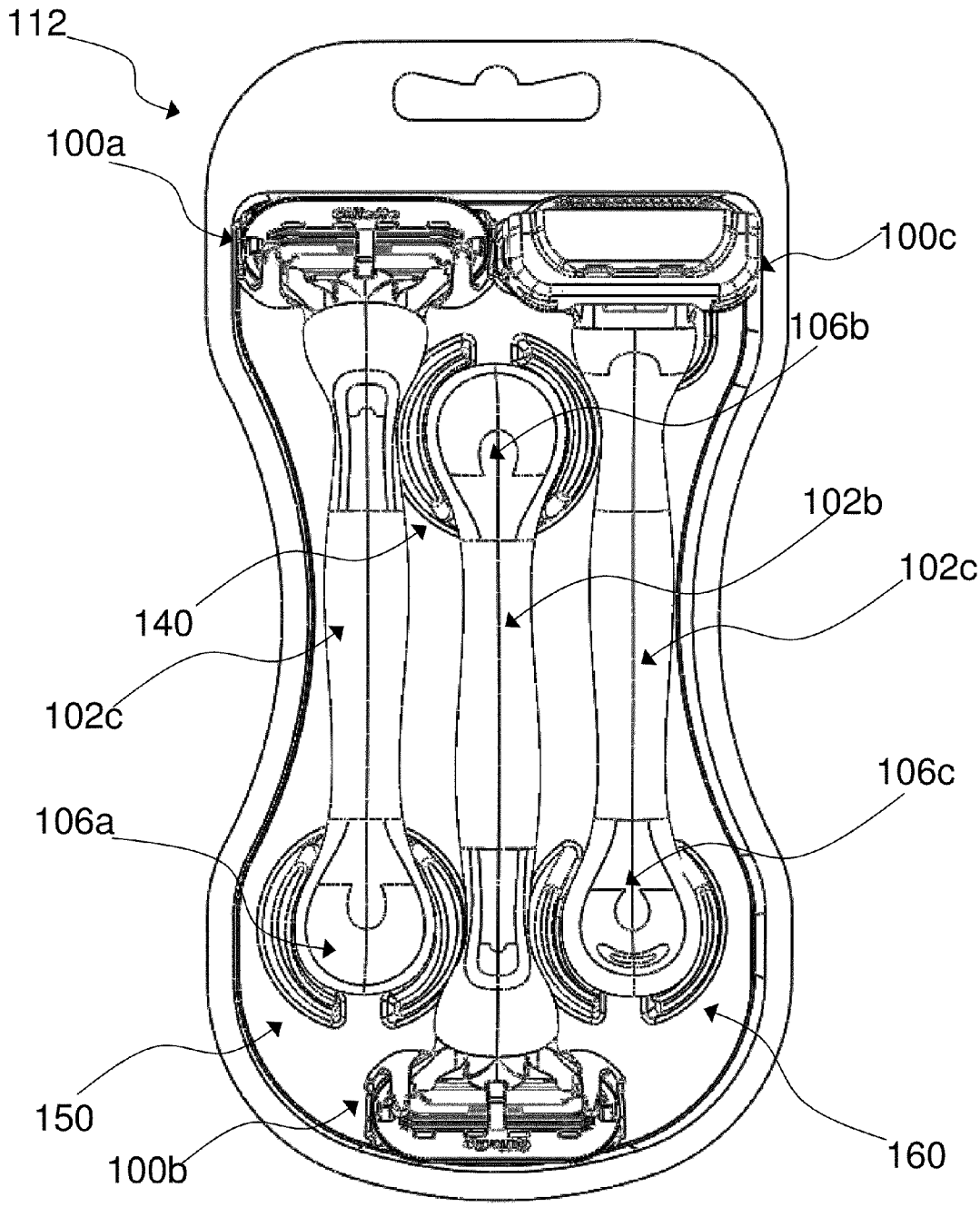
FIG. 5A is a top plan view of another possible embodiment of a tub and three of the shaving razors of FIG. 3.
Figure 5B:
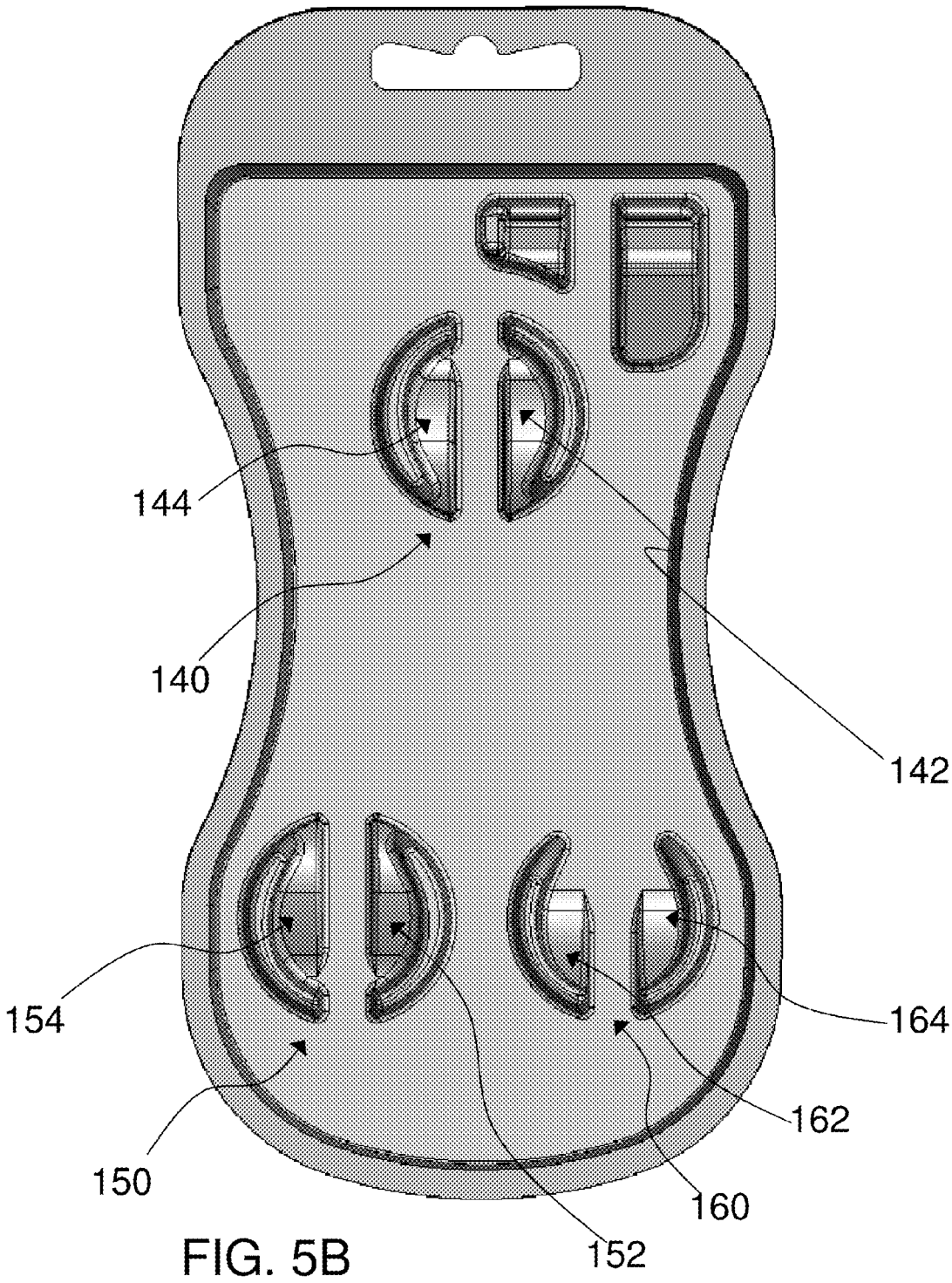
FIG. 5B is a top plan view of the tub of FIG. 5A.

Referring to FIGS. 5A and 5B, a top view of another possible embodiment of a tub 112 is shown which may be incorporated into the package 10 of FIG. 1. The tub 112 may be the same or similar as the tub 12 as previously described, except that the tub 112 may have one or more retaining members 140, 150, and 160 which nestingly receives the distal end portions 106*a*, 106*b* and 106*c* of the respective handles 102*a*, 102*b*, and 102*c*. The retaining members 140, 150, and 160 may be arcuate, generally circular, or semi-circular and define a recess that is dimensioned to nestingly receive the respective distal end portions 106*a*, 106*b*, and 106*c* of the handles 100*a*, 100*b*, and 100*c*. In certain embodiments, one or more of the retaining members 140, 150, and 160 may surround or border about 40%, 50%, or 60% to about 70%, 80% or 90% of one or more of the respective distal end portions 106*a*, 106*b* and 106*c*. One or more of the retaining members 140, 150, and 160 may have a continuous wall or a segmented wall (as shown). The retaining members 140, 150, and 160 may have one or more ramps 142 and 144, 152 and 154, and 162 and 164 that incline or decline. The ramps 142 and 144, 152 and 154, and 162 and 164 may have a contoured top surface that corresponds to a contoured surface on the top and/or bottom surfaces on the distal end portions 106*a*, 106*b*, and 106*c* of the respective handles 102*a*, 102*b*, and 102*c*. The ramps 142 and 144, 152 and 154, and 162 and 164 may support the respective distal end portions 106*a*, 106*b*, and 106*c* add stability to the shaving razors 100*a*, 100*b*, and 100*c* within the tub 12. The distal end portions 106*a*, 106*b*, and 106*c* and the respective retaining members 140, 150, and 160 may have a slip fit configuration in which the distal end portions 106*a*, 106*b*, and 106*c* are loosely held in place by the respective retaining members 140, 150, and 160. Alternatively, the distal end portions 106*a*, 106*b*, and 106*c* and the respective retaining members 140, 150, and 160 may have a snap or press fit configuration in which the distal end portions 106*a*, 106*b*, and 106*c* are more tightly held in place by the respective retaining members 140, 150, and 160.

Figure 6:
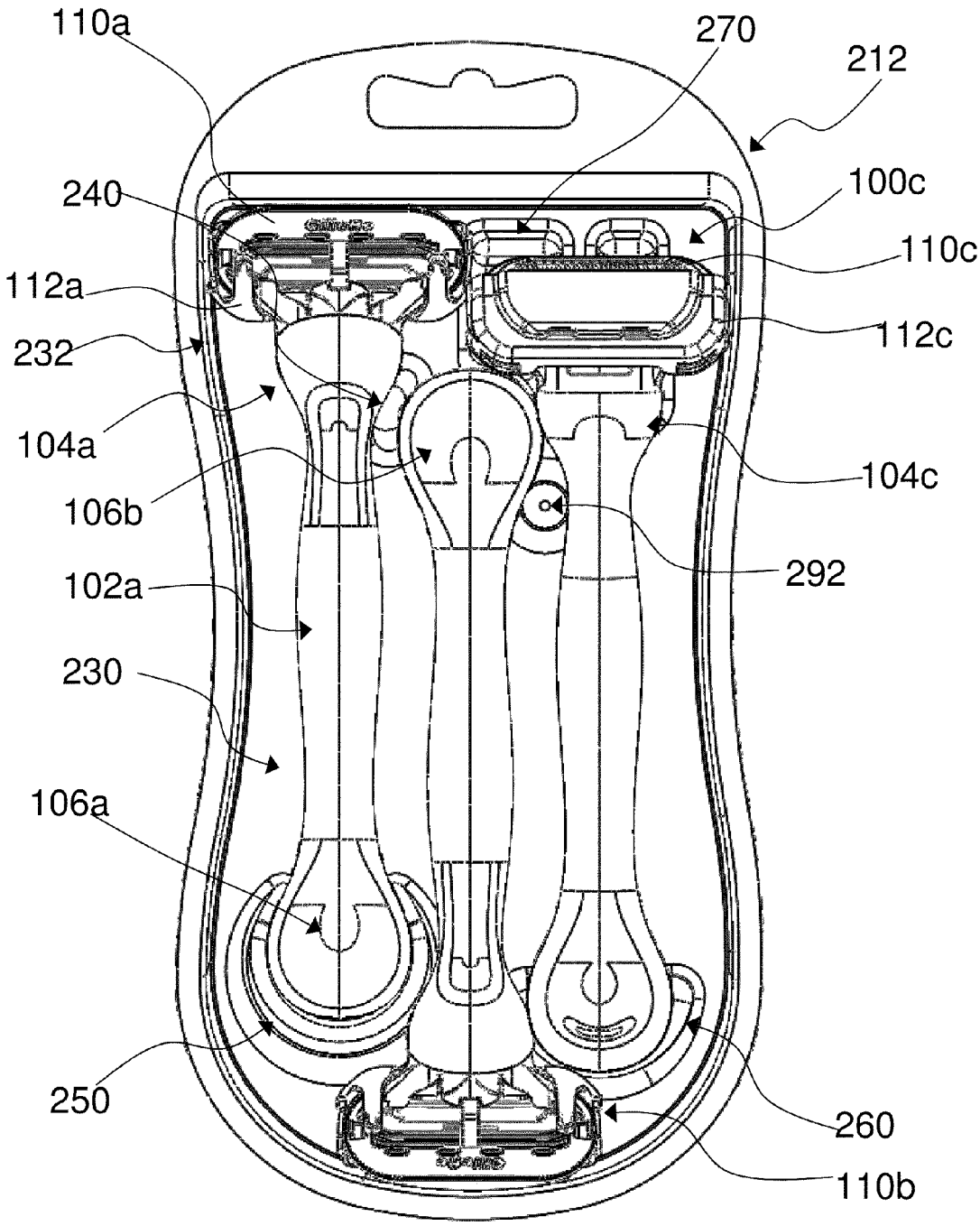
FIG. 6 is a top plan view of another possible embodiment of a tub and three of the shaving razors of FIG. 3.

Referring to FIG. 6, a top view of another possible embodiment of a tub 212 is shown which may be incorporated into the package 10 of FIG. 1. The tub 212 may be the same or similar as the tub 12 as previously described, except that the tub 212 may have an additional fifth retaining member 292 projecting from a bottom surface 230. The fifth retaining member 292 may be located at a proximal end portion of the tub 212, opposite a second and third retaining member 250 and 260. The fifth retaining member 292 may have a generally cylindrical or conical shape to facilitate the holding and proper spacing of the second and third shaving razors 100*b* and 100*c*. The fifth retaining member 292 may be configured to engage or contact the distal end portion 106*b* of the second shaving razor 100*b* and the proximal end portion 104*c* of the third shaving razor 100*c*.

The tub 212 may have first and fourth retaining members 240 and 270 similar to the first and fourth retaining members 40 and 70 of FIG. 2A, as previously described. The tub 212 may also have second and third retaining members 250 and 260 which may be the same or similar to the second and third retaining members 50 and 60 of FIG. 2A, however, the second and third retaining members 250 and 260 may substantially nestingly receive the distal end portions 106*a* and 106*c* of the first and third shaving razors 100*a* and 100*c*. In certain embodiments, the second and third retaining members 250 and 260 may have a continuous wall that surrounds or borders about 40%, 50%, or 60% to about 70%, 80% or 90% of one or more of the respective distal end portions 106*a* and 106*c*. The second and third retaining members 250 and 260 may provide a slip fit configuration in which the respective distal end portions 106*a* and 106*c* are loosely held in place by the respective retaining members 250 and 260. Alternatively, the second and third retaining members 250 and 260 and the respective distal end portions 106*a* and 106c may have a snap or press fit configuration in which the distal end portions 106*a* and 106c are more tightly held in place by the respective retaining members 250 and 260.

The first shaving razor 100*a* may be secured laterally and/or longitudinally within the tub 212 by contacting or engaging a plurality of different surfaces. For example, the cartridge 110*a* (or cartridge cover 112*a*) of the first shaving razor 100*a* may be positioned between a perimeter wall 232 of the tub 212 and the fourth retaining member 270. The proximal end portion 104*a* may also contact the first retaining member 240 to limit lateral movement of the shaving razor 100*a*. The first shaving razor 100*a* may be positioned between the perimeter wall 232 and the second retaining member 250 to limit longitudinal movement of the first shaving razor 100*a*. The second retaining member 250 may nestingly receive the distal end portion 106*a* of the first shaving razor 100*a* to limit lateral and/or longitudinal movement of the first shaving razor 100*a*. The perimeter wall 232 may also contact the cartridge 110*a* (or cartridge cover 112*a*) to limit any unwanted longitudinal movement of the shaving razor 100*a*.

The second shaving razor 100*b* may also be secured laterally and/or longitudinally within the tub 212 by contacting or engaging a plurality of different surfaces. For example, the handle 102*b* may be positioned between the first retaining member 240 and the fifth retaining member 292 to limit lateral and/or longitudinal movement of the second shaving razor 100*b*. The proximal end portion 104*b* of the second shaving razor 102*b* may be secured between the second and third retaining members 250 and 260 to limit lateral and/or longitudinal movement of the second shaving razor 100*b*. The second and third retaining members 250 and 260 may also limit the shaving razor 100*b* from moving longitudinally in a first direction and the perimeter wall 232 may limit the shaving razor from moving longitudinally in a second direction.

The third shaving razor 100*c* may be secured laterally and/or longitudinally within the tub 212 by contacting or engaging a plurality of different surfaces. For example, the third shaving razor 100*c* may be positioned between the perimeter wall 232 of the tub 212 and the fifth retaining member 292 to limit lateral movement of the third shaving razor 100*c*. The fifth retaining member 292 may contact the proximal end portion 104*c* and the perimeter wall 232 may contact the cartridge 110*c* (or cartridge cover 112*c*). The third retaining member 260 may substantially nestingly receive the distal end portion 106*c* to limit lateral and/or longitudinal movement of the third shaving razor 100*c*. The third shaving razor 100*c* may also be secured longitudinally between the third retaining member 260 and the fourth retaining member 270. The fourth retaining member 270 may hold the cartridge 110*c* at a predetermined pivot angle, as previously described.

Figure 7:
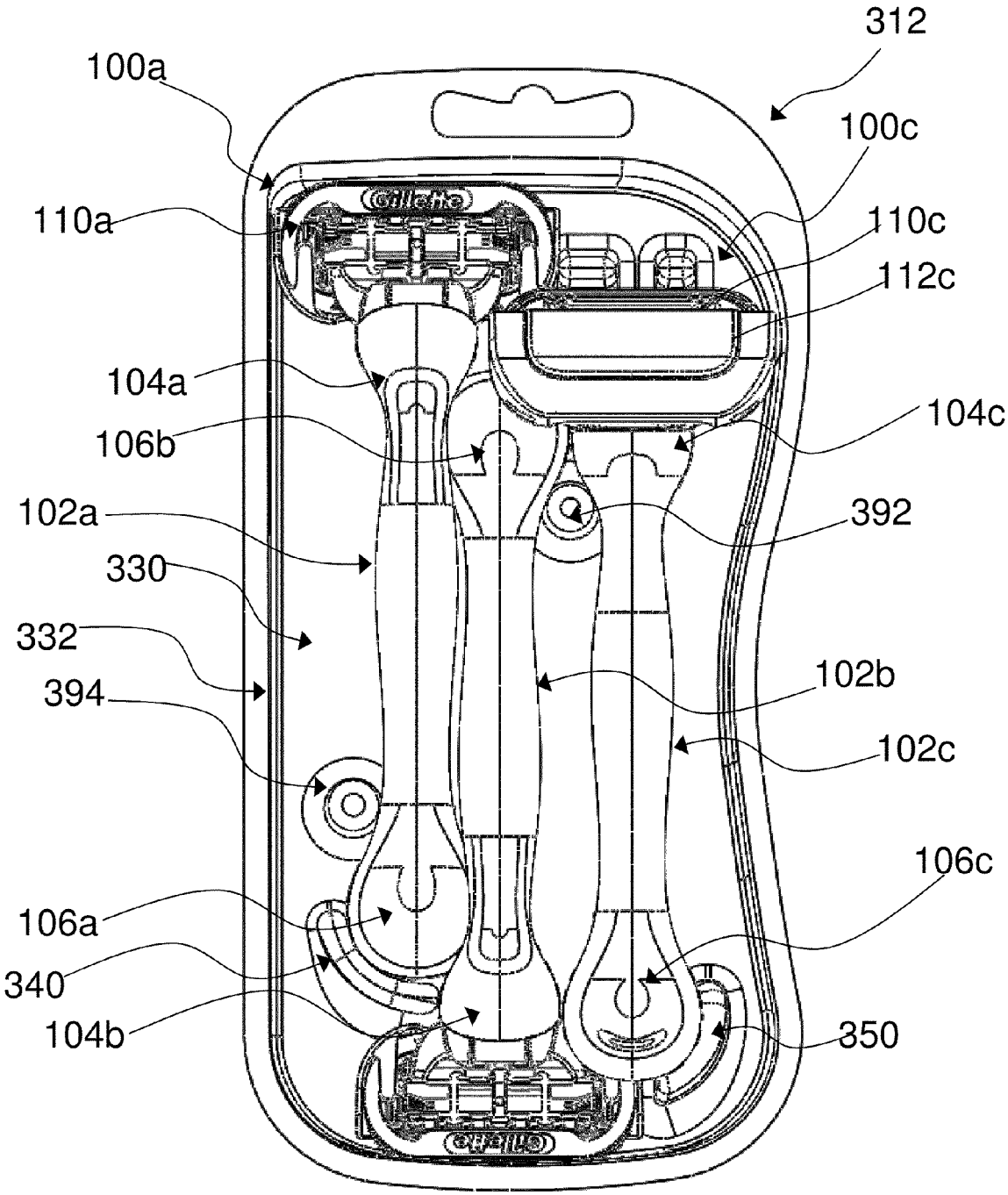
FIG. 7 is a top plan view of yet another possible embodiment of a tub and three of the shaving razors of FIG. 3.

Referring to FIG. 7, a top view of another possible embodiment of a tub 312 is shown which may be incorporated into a package similar to the package 10 shown in FIG. 1. The tub 312 may be similar to the other embodiments previously described, however the tub 312 may allow for a more compact arrangement of the plurality of shaving razors 100*a*, 100*b* and 100*c*. The tub 312 may have a smaller footprint than the tub 12 shown in FIG. 2A. The tub 312 may have a bottom surface 330 that is defined by a perimeter wall 332 having a generally straight side wall and an opposing side wall having a gentle curve. The perimeter wall 332 may also have a pair of opposing end walls that are generally straight or curved. In certain embodiments, the cartridge 110*c* (and/or cover 112*c*) of one the shaving razors 100*c* may overlap the distal end portion 106*b* of an adjacent shaving razor 100*b* to minimize the size of the tub 312. The tub 312 may not have a first retaining member 40, as shown in FIG. 2A. The elimination of the first retaining member 40 may allow the shaving razors 100*a*, 100*b* and 100*c* to be packaged in a tighter arrangement, thus minimizing the tub 312 size. As will be described in greater detail below, shaving razors 100*a*, 100*b* and 100*c* may be arranged to contact each other to minimize wasted space and further aid in securing the shaving razors 100*a*, 100*b* and 100*c* within the tub 312.

The tub 312 may have a fifth and sixth retaining members 392 and 394 that project from the bottom surface 330. The sixth retaining member 394 may be located at a distal end portion of the tub 312 and may be configured to contact the distal end portion 106*a* of the first shaving razor 100*a*. The fifth retaining member 392 may be located at a proximal end portion of the tub 312 and may be configured to contact both the distal end portion 106*b* of the second shaving razor 100*b* and the proximal end portion 104*c* of the third shaving razor 100*c*. The fifth and sixth retaining members 392 and 394 may have a generally cylindrical or conical shape to facilitate the holding and proper spacing of one or more of the shaving razors 100*a*, 100*b* and 100*c*.

The first shaving razor 100*a* may be secured laterally and/or longitudinally within the tub 312 by contacting or engaging a plurality of different surfaces. For example, the cartridge 110*a* of the first shaving razor 100*a* may be positioned between the perimeter wall 332 of the tub 312 and the third retaining member 370 to limit lateral movement of the first shaving razor 100*a*. Lateral movement of the first shaving razor may also be limited by the proximal end portion 104*a* of the handle 102*a* contacting the distal end portion 106*b* of the handle 102*b*. The distal end portion 106*a* of the first shaving razor 100*a* may be secured laterally by the second retaining member 340, the proximal end portion 104*b* of the second shaving razor 1O*b*, and the sixth 394 retaining member. The first shaving razor may 100*a* be positioned between the perimeter wall 332 of the tub 312 and the third retaining member 340 to limit longitudinal movement.

The second shaving razor 100*b* may be secured laterally and/or longitudinally within the tub 312 by contacting or engaging a plurality of different surfaces. For example, the distal end portion 106*b* of the second shaving razor 100*b* may be positioned between the proximal end portion 104*a* of the first shaving razor 100*a* and the fifth retaining member 392 to limit lateral movement. The proximal end portion 104*b* of the second shaving razor 100*b* may also be positioned between the distal end portions 106*a* and 106*c* of the first and third shaving razors 100*a* and 100*c* to limit lateral movement. The proximal end portion 104*b* of the second shaving razor 100*b* may also contact the second retaining member 340 to limit lateral movement. The second shaving razor 100*b* may be positioned between the perimeter wall 332 and the fourth retaining member 370 to limit longitudinal movement.

The third shaving razor 100*c* may be secured laterally and/or longitudinally within the tub 312 by contacting or engaging a plurality of different surfaces. For example, the third shaving razor 100*c* may be secured between the perimeter wall 332 of the tub 312 and the fifth retaining member 392 to limit lateral movement. The cartridge 110*c* (or cover 112*c*) may contact the perimeter wall 332 and the proximal end portion 104*c* may contact the fifth retaining member 392. The handle 102*c* of the third shaving razor may be positioned between the proximal end portion 104*b* of the second shaving razor 100*b* and the third retaining member 350 to limit lateral movement. The third shaving razor 100*c* may be positioned between the third retaining member 350 and the fourth retain member 370 to limit longitudinal movement.

The tub 312 may provide for improved spacing and holding the shaving razors 100*a*, 100*b* and 100*c* by securing them in both a lateral and longitudinal direction. The improved spacing and holding may help prevent damage to the shaving razors 100*a*, 100*b* and 100*c* during shipping and ensure an aesthetically pleasing package to a potential consumer at a point of sale display. In any of the embodiments described above, the tubs 12, 112, 212 and 312 may provide for a slip fit, press fit or snap fit configuration to secure or hold the shaving razors 100*a*, 100*b* and 100*c*.

Figure 8A:
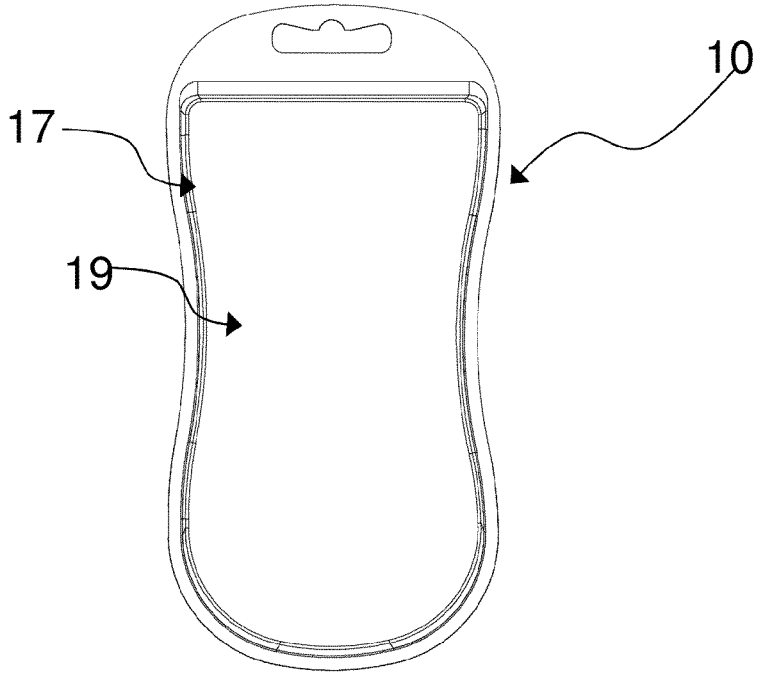
FIG. 8A is a bottom plan view of the package of FIG. 1.
Figure 8B:
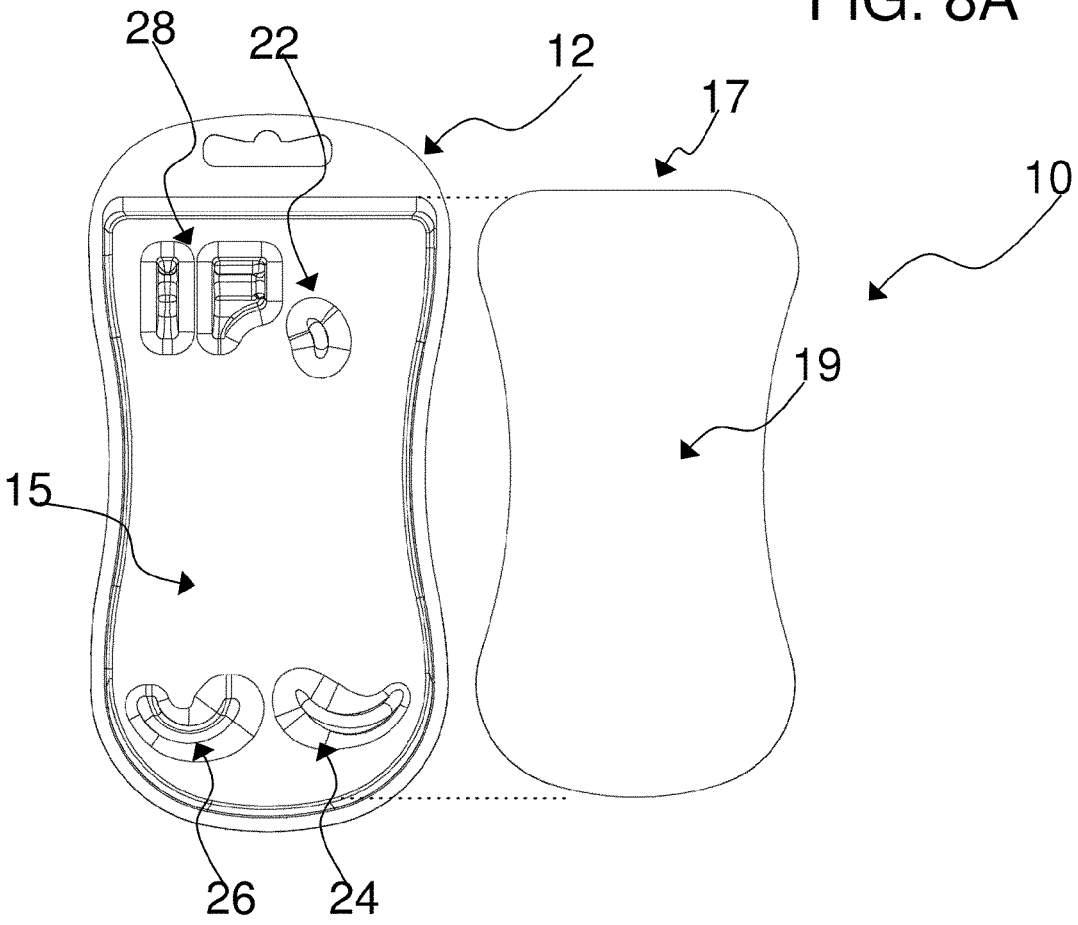
FIG. 8B is a bottom assembly view of the package of FIG. 8A.

Referring to FIGS. 8A and 8B, a bottom plan view and a bottom assembly view of the package 10 is illustrated. As shown in FIG. 8B, the retaining members 40, 50, 60, and 70 (not shown) may create recesses 22, 24, 26, and 28 on a back surface 15 of the tub 12. These recesses 22, 24, 26, and 28 may not be aesthetically pleasing to the consumer. The back surface 15 is generally flat and level which facilitate the placement of an adhesive label 17 onto the back surface 15. The label 17 may have a back side 19 and an opposite front side (not shown) that may contain various graphics and information regarding the contents of the package 10. If the lid 14 (not shown) and the bottom surface 30 (not shown) of the tub 12 are generally clear, the consumer may be able to see the front side (not shown) of the label 17 through the lid 14 (not shown). The back side 19 and the front side (not shown) of the label 17 may be opaque to better conceal the recesses 22, 24, 26, and 28. The label 17 may be a pressure sensitive adhesive label. The combination of the generally flat and level back surface 15 of the tub 12 and the addition of the label 17 minimizes packaging costs and also maximizes the area available to print graphics and information regarding the contents of the package 10. The label 17 may cover a significant portion of the back surface 15 of the tub 12. In certain embodiments, the label 17 may cover about 70%, 75%, or 80% to about 85%, 90%, 95% or even 100% of the back surface 15 of the tub 12. Although FIGS. 8A and 8B illustrate the label 17 with the tub 12, the label 17 may be utilized with any of the tubs 112, 212, and 312 previously described.

Further modifications and alternative embodiments of various aspects of the invention will be apparent to those skilled in the art in view of this description. The components and structures of any particular embodiment illustrated and described herein may be interchangeable with any other components and structures illustrated and described herein, all as would be apparent to one skilled in the art after having the benefit of this description of the invention.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm". In an effort to avoid any ambiguity, for the purposes of this disclosure, the term "portion" shall be construed as meaning less than 50%. For example, the term "distal end portion" should be interpreted as from about 0%, 5%, 10%, or 15% to about 15%, 20%. 25%, 30%, 40% or 45% from the terminal end of the element referenced. Similarly, the term "proximal end portion" should be interpreted as from about 0%, 5%, 10%, or 15% to about 15%, 20%. 25%, 30%, 40% or 45% from the end opposite the terminal end of the element referenced.

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A disposable razor package comprising:

a first shaving razor having a proximal end portion with a cartridge and an enlarged distal end portion;

a second shaving razor having a proximal end portion with a cartridge and an enlarged distal end portion;

a tub having a generally level bottom surface defined by a perimeter wall;

a first retaining member projecting from the bottom surface, a second retaining member engaging the enlarged distal end portion of the first shaving razor, the second retaining member projecting from the bottom surface and having a curved profile that limits lateral movement of the distal end portion of the first shaving razor, the second retaining member engages the distal end portion of the first shaving razor and the proximal end portion of the second shaving razor, the enlarged distal end portion of at least one of the shaving razors contacts the bottom surface of the tub; and a third shaving razor having a proximal end portion with a cartridge and an enlarged distal end portion and a third retaining member projecting from the bottom surface, the third retaining member having first and second surfaces, wherein the second surface of the third retaining member engages the enlarged distal end portion of the third shaving razor and the first surface of the third retaining member engages the proximal end portion of the second shaving razor.

2. The disposable razor package of claim 1 wherein second retaining member nestingly receives about 40% to about 90% of the enlarged distal end portion of the first shaving razor.

3. The disposable razor package of claim 1 wherein a plurality of the retaining members are generally arcuate.

4. The disposable razor package of claim 3 wherein second retaining member nestingly receives about 50% to about 90% of the enlarged distal end portion of the third shaving razor.

5. The disposable razor package of claim 1 further comprising a fourth retaining member projecting from the bottom surface, the fourth retaining member having first and second surfaces and a top surface with a V shaped notch, wherein the first surface of the fourth retaining member engages the distal end portion of the second shaving razor.

6. The disposable razor package of claim 5 wherein the notch of the fourth retaining member engages the cartridge of the third shaving razor.

7. The disposable razor package of claim 6 wherein the second surface of the fourth retaining member engages the cartridge of the first shaving razor.

8. The disposable razor package of claim 5 wherein one or more of the retaining members is circular.

9. The disposable razor package of claim 5 wherein one or more of the retaining members is segmented.

10. The disposable razor package of claim 1 wherein at least one of the retaining members is circular and has a ramp that supports an enlarged distal end portion of one of the shaving razors.

* * * * *

UNITED STATES PATENT AND TRADEMARK OFFICE

CERTIFICATE OF CORRECTION

PATENT NO. : 7,854,320 B2
APPLICATION NO. : 12/367713
DATED : December 21, 2010
INVENTOR(S) : Jeffrey Allen Greene et al.

It is certified that error appears in the above-identified patent and that said Letters Patent is hereby corrected as shown below:

Column 8

Line 59, delete "1O*b*" and insert --100*b*--.

Signed and Sealed this
Eighth Day of February, 2011

David J. Kappos

David J. Kappos
*Director of the United States Patent and Trademark Office*